US005398365A

United States Patent [19]

MacKenzie

[11] Patent Number: 5,398,365

[45] Date of Patent: Mar. 21, 1995

[54] SELF-CLEANING PAINT BRUSH

[76] Inventor: Kieran MacKenzie, 1033 Main St. E., Hamilton, Ontario, Canada, L8M 1N4

[21] Appl. No.: 85,630

[22] Filed: Jul. 2, 1993

[51] Int. Cl.[6] ..... A46B 11/06

[52] U.S. Cl. ..... 15/160; 15/205.2; 401/289; 285/8; 285/12

[58] Field of Search ..... 15/159.1, 160, 205.2; 401/286, 287, 288, 289; 285/8, 12; 239/289, 531

[56] References Cited

U.S. PATENT DOCUMENTS

| | | | |
|---|---|---|---|
| 846,614 | 3/1907 | Pugh | 401/289 |
| 863,571 | 8/1907 | Kintner | 285/8 |
| 960,362 | 6/1910 | Maendler | 15/160 |
| 975,873 | 11/1910 | Knickerbocker | 285/8 |
| 1,000,414 | 8/1911 | Kintner | 285/8 |
| 1,467,337 | 9/1923 | Runkle | 401/289 |
| 1,491,625 | 4/1924 | Porter | 401/288 |
| 1,598,811 | 9/1926 | Ferrin | 401/289 |
| 1,617,569 | 2/1927 | Boyle | 401/289 |
| 1,928,929 | 10/1933 | Craig | 401/289 |
| 2,051,211 | 8/1936 | Hagopian | 285/8 |
| 2,094,889 | 7/1938 | Hooper | 285/8 |
| 2,516,778 | 7/1950 | Kreidenweiss | 15/205.2 |
| 2,525,419 | 10/1950 | Mellinger | 285/8 |
| 2,699,357 | 1/1955 | Roth | 285/8 |
| 2,790,986 | 5/1957 | Schwartz | 15/159.1 |
| 3,227,380 | 1/1966 | Pinkston | 401/289 |
| 3,332,102 | 7/1967 | Brinker | 401/289 |
| 4,166,304 | 9/1979 | Flynn | 15/205.2 |
| 4,266,813 | 5/1981 | Oliver | 285/12 |
| 4,311,404 | 1/1982 | Kodera | 401/289 |

FOREIGN PATENT DOCUMENTS

| | | | |
|---|---|---|---|
| 0212543 | 8/1956 | Australia | 15/159.1 |
| 397856 | 5/1909 | France | 401/289 |
| 2575909 | 7/1986 | France | 401/289 |
| 3031495 | 10/1981 | Germany | 401/289 |
| 12108 | 11/1913 | United Kingdom | 401/288 |

*Primary Examiner*—David A. Scherbel
*Assistant Examiner*—Randall E. Chin

[57] ABSTRACT

A paint brush includes a receptacle at the end of the handle of the brush designed to be attached to standard water faucets, garden hoses, or other fluid sources for self cleaning. When attached to the faucet, fluid enters a hollow receptacle and then into a hollow handle and into the brush head where the fastened ends of the bristles are encased. Gaps between the bristles allow fluid to pass down into the bristles dissolving paint clinging to the bristles thus cleaning the brush. The handle can be removed from the head and the receptacle can be removed from the handle and the receptacle can be directly attached to the head to enable the receptacle and head to be attached to a faucet.

3 Claims, 3 Drawing Sheets

SELF-CLEANING PAINT BRUSH

This invention is designed to be hooked up to a water faucet, garden hose, or other fluid source its design, enabling flow from said fluid source to clean off paint clinging to bristles, furthemore, the design keeps paint off the outside of the said head when the brush is being used to paint.

BACKGROUND OF INVENTION

1. Field of the Invention

The present invention relates to paint brushes, especially those used for house painting.

2. Discussion of Prior Art

Paint brushes have been cleaned previously by manually holding them under a faucet or tap, in the case of latex paints, with the ends of the bristles facing up towards the flow of water or solvent. Often the result of such action is the bristles would be bent in many directions out of shape. In addition, the brush had to be held under the flow for a significant length of time. Often when cleaned this way, the paint in the middle, inside, upper area of the said bristles, near the head of the brush, would not be completely cleaned off due to its hidden state. The said paint there would later dry and harden, thus stiffen the same brush, reduce flexibility, and subsequently adversely affect the future use of the brush.

Furthermore, the time it would take to clean the brush this way would be significant.

Another method of cleaning is to soak the brush, as with U.S. Pat. Nos. 4,149,628 and 3,955,670. However, the brush still requires rinsing using the same process described above.

The U.S. Pat. No. 1,928,929 named Craig, does not have any gaps between the inside perimeter of the ferrule and the outer periphery of the bristles, thus not allowing direct flow of water on to the bristles on the said outer periphery of said bristles, nor preventing pain on the said periphery of bristles from flowing on to the outside sides of the ferrule where the brush is held by the painter's hand.

Finally, another method of cleaning is to place the brush on a brush spinner, a device which spins the brush with the brush's handle as the axis. The brush must be first dipped in water or solvent. Then, when the spinner is spun, by virtue of centrifugal force, the paint on the brush is forced off. However, it takes several cycles of dipping then spinning to remove all paint, and again, often missed is the paint in the middle, upper, inside area of the bristles, which, as described above, later hardens and inhibits the full use of the brush.

Furthermore, due to the centrifugal force from the spinning, the bristles are bent outwards at all four sides, thus deforming the proper shape of the brush inhibiting its future use.

SUMMARY OF INVENTION

The self-cleaning brush aims to eliminate the mess on the hands of the patron when painting with the brush, when cleaning a paintbrush, the time it previously took to clean a paint brush, the paint on the middle, upper area of the bristles, near the said head, often missed by other methods of cleaning, and eliminate damage to the shape of the bristles due to either spinning or water flow at angles to the bristles. Other objects and advantages of the present invention will become apparent as the description proceeds.

The self-cleaning brush is ideal for latex, that is, water soluble paints, since it can be hooked up to a water faucet or garden hose. The flow of water cleans the brush by itself. There is no deforming of the shape of the bristles because said flow enters the head where the bristles are attached and continues in the direction parallel to that of the length of the bristles. The brush is hooked on to a faucet by a receptacle attached at the top of the brush's handle. The receptacle has threading for standard faucets or taps so that it can be screwed on easily and firmly hold brush in place to a faucet during the flow of water. The water flows down through the hollow handle into, then through the head of the brush and into, then through the bristles, in the same direction of the bristles, eventually out the end of the bristles taking dissolved paint in the process. The gaps among the bristles in the said head which allow said water to flow, include gaps between the outside periphery of the bristles and the inside perimeter of the said head. These said gaps serve also to prevent flow of paint from the said bristles to the outside of the said head while brush is being used to paint. This helps painters hands remain free of paint.

The handle can be removed in order to attach the receptacle to the head to become one unit, then attach said unit to the faucet for tight conditions. This said head can also be attached to a non-threaded water tap with an upside down U-shaped wire, each free end hooked on to a side of the brush then the same wire pulled over the same tap, allowing the head to hang below the same tap, allowing free flow of water directly into said head, and then continuing on as described above.

In all described modes of attachment of the invention to a faucet or fluid source, the patron does not have to be present during the cleaning process after the same invention is attached to the faucet and flow of fluid is activated.

A more detailed explanation of the invention is provided in the following description and claims, and is illustrated in the accompanying drawings.

BRIEF DESCRIPTION OF THE DRAWINGS

FIG. 3 shows the brush actually attached to a faucet or tap with the water flow on.

DESCRIPTION OF THE ILLUSTRATED EMBODIMENTS

Figure 1:
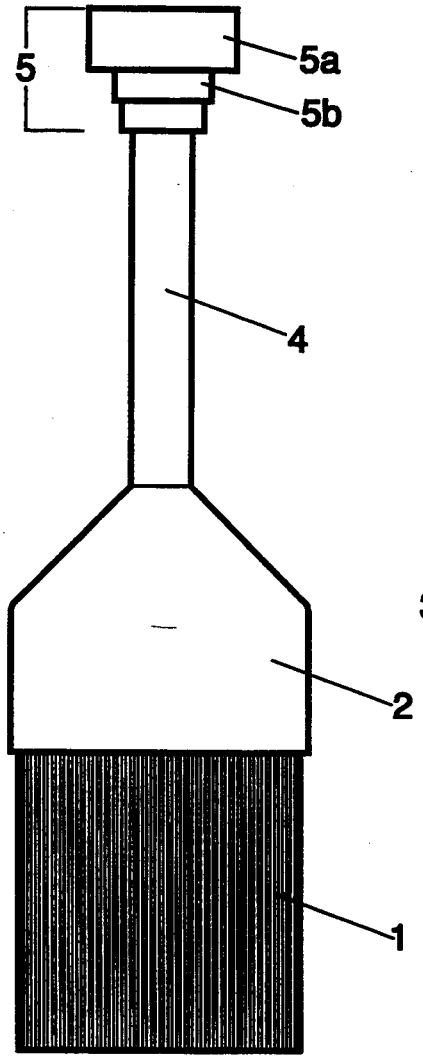
FIG. 1 is a front and/or back view of the self-cleaning brush produced according to the invention.
Figure 2:
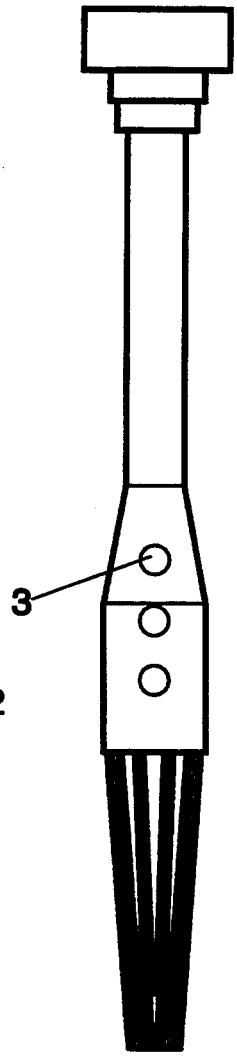
FIG. 2 is a side view, or the previous view of FIG. 1 turned 90°.

FIG. 1 is the front or back view of the brush. The brush is symmetrical. Its appearance resembles that of an ordinary paint brush used typically for house painting with, however, some new added important features. In its present condition, as in FIG. 1, it can be attached to a fluid source, for example, a water faucet. The top receptacle, 5, is threaded inside at its top, such that it can be attached to more than one size of threaded water faucets, or to a garden hose. It can fit a large faucet that corresponds to fit at 5*a*, or a smaller faucet to be fitted into the threading at 5*b*. Water or fluid passage is allowed down through the handle due to hollow parts 5, 4, 2, and then into gaps, 15, inside the head, 2, which will allow fluid passage to continue through the head and down into and around the bristles, 1, eventually down to the bottom of the bristles and then exiting there, thus dissolving and removing, by virtue of the flow of water or solvent, any paint that is clinging to any bristles anywhere on the periphery of the bristles or any bristle encompassed within the periphery of the bristles. Since the bristles are not attached to each other outside, or below, the head, fluid flow is able to reach all bristles and dissolve and remove the paint.

Figure 3:
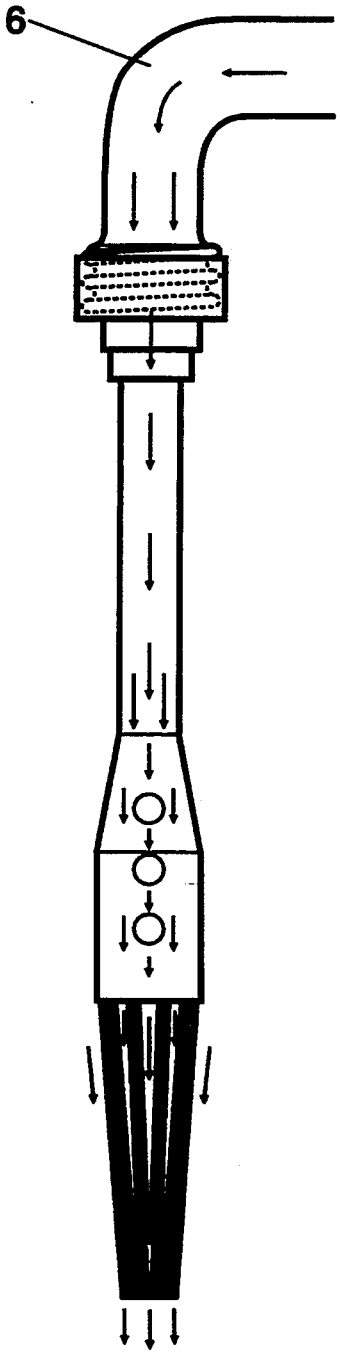

FIG. 3 shows the brush attached to a fluid source, 6, in this diagram, a water faucet, and shows the path of the fluid. The fluid, at even a low volume, would collect somewhat in the bristles causing pressure pushing water down to amongst all the bristles.

Figure 4:
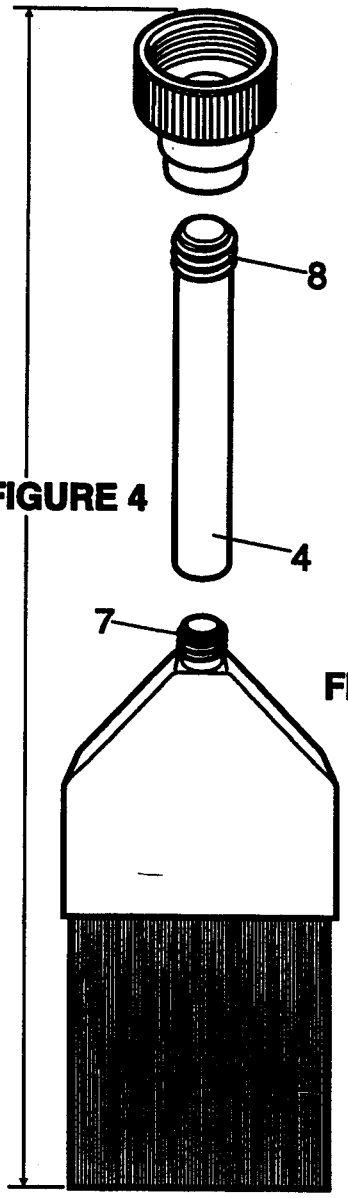
FIG. 4 demonstrates that the midsection of the said handle and the top receptacle member can both be detached.
Figure 5:
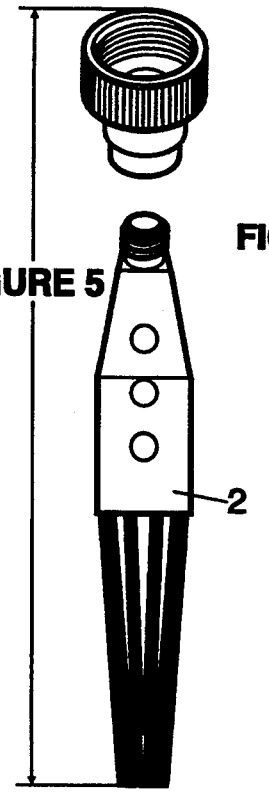
FIG. 5 shows that the top receptacle can be attached to the lower head of the brush.
Figure 6:
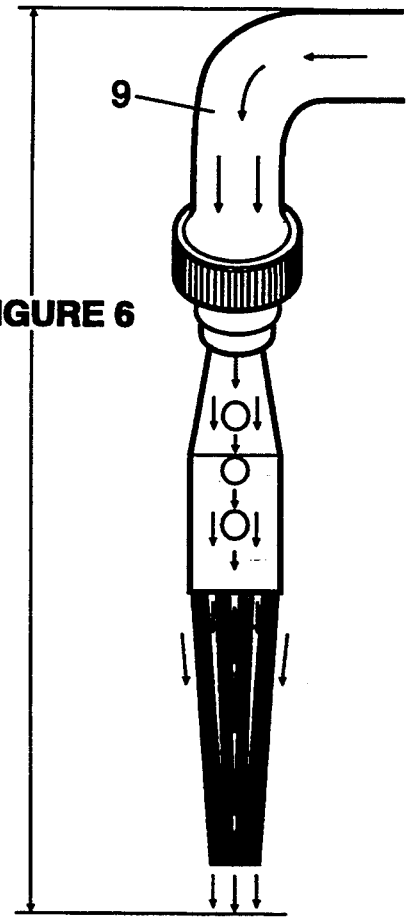
FIG. 6 shows the top receptacle attached to the head which is then attached to a water faucet.

FIG. 4 shows that the brush can be dismantled by virtue of threading at 7, which fits into and can be unscrewed from the bottom of the shaft, 4, and at 8 which fits into and thus can be unscrewed from the bottom of 5 also by virtue of threading. In FIG. 5, the top piece 5, i.e. the receptacle, can then be fitted to the threaded portion at 7, on the head. This enables the brush to be attached to water sources in the above manner, as in FIG. 6, for restricted tight spaces. FIG. 6 demonstrates a smaller faucet that the receptacle 5 is designed to fit at point 5*b*.

Figure 7:
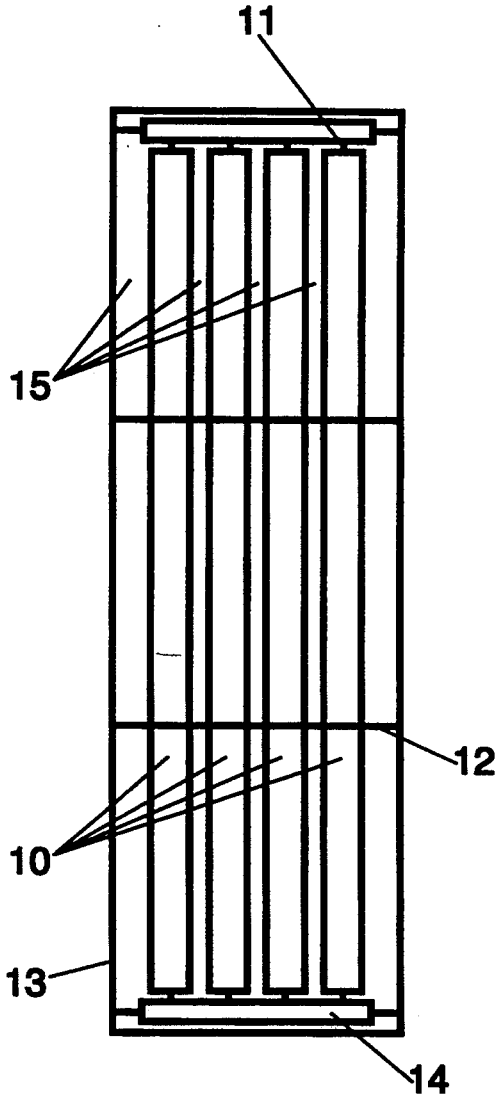
FIG. 7 shows an aerial view of inside the head of the brush where the bristles are attached.

In FIG. 7, the concept of gaps in the head where the bristles originate is shown in this aerial view of inside the head. These gaps in the head include gaps between the inside perimeter of the head and the rows of bristles closest in proximity to said inside of head. Not only do said gaps allow the flow of water to flow on to the outside visible periphery of the bristles, but said gaps also prevent flow of paint from said bristles to the outside of the said head when said brush is in use to paint. This particular design is such that there are columns of bristles, each of which have the bristles' ends bunched together in a rectangular line, each bristle's end attached to a rectangular end piece or top piece, 10. This said rectangular end piece has rods at either end, 11, which fit into slots inside the brush's head, all slots corresponding to the proximity of the said rods.

Crosspieces, 12, add further support and are attached to the rods of the said columns, and attached to the inside of the head at 13 in the same manner as the same rods of the columns of bristles are attached as described above. The columns of bristles are constructed so that they converge together towards the opposite end of the head, i.e. the bottom of the brush, such that there are no gaps at the same bottom. That is, the bristles are neatly bunched together at the said bottom. A row of bristles, 14, which is constructed in the same manner as a column of bristles, as in FIG. 7, is placed on both of the short sides of the brush to assist in water pressure buildup, although not absolutely imperative. FIGS. 3, 5, and 6 show the bristles' configuration without said side rows of bristles. The said configuration of columns of bristles form a wedge-like shape that eliminates the gaps towards the lower free ends of the bristles such at the bottom of 1. One can see the gaps that would be otherwise concealed by the rows, 14 on the ends of the head.

Figure 8:
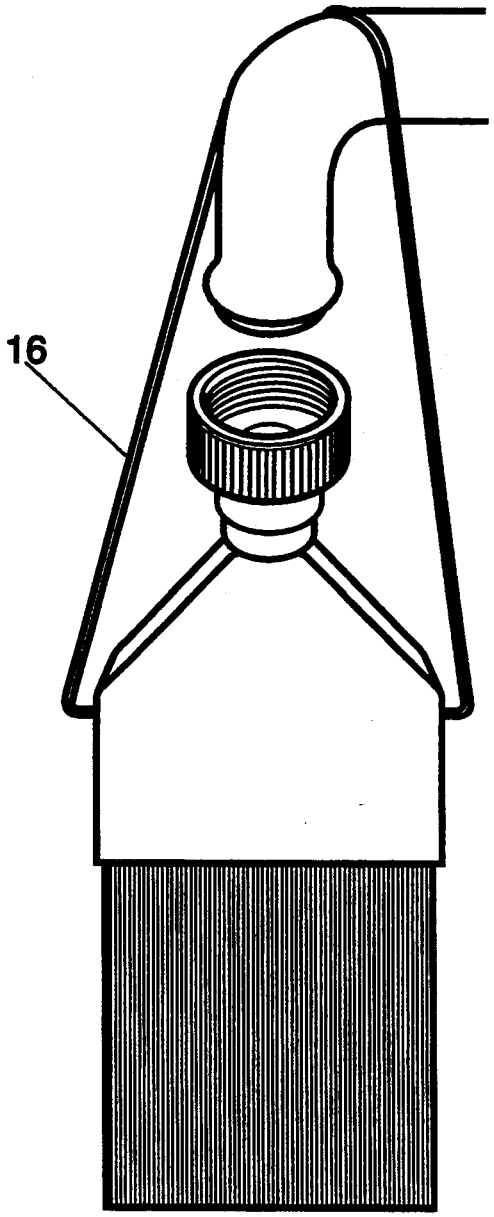
FIG. 8 shows that the head of the brush can be hung under a threadless water faucet by virtue of an upside down U-shaped wire fasted into slots on the sides of the brush, then the same wire pulled over faucet.

FIG. 8 demonstrates that the said head 2, can be attached underneath a non-threaded faucet by virtue of an upside-down U-shaped wire, 16, the ends of said wire bent to fit into notches, 3, at the side of the brush, then the same wire is pulled over the said faucet to allow the head to hang under the faucet to receive the flow of water. There are at least two corresponding pairs of said notches, 3, to allow the said wire to be adjusted to fit the faucet.

I claim:

1. A brush comprising a hollow handle open at both ends, removably joined at one end to a brush head having inside walls and outer walls said brush head contains therein an upper part of clusters of bristles arranged in rows which are horizontally secured to said head by top pieces emanating from the inside walls of said head, and which are attached to said upper part of said clusters; there being gaps between said rows inside said head and gaps between the inside walls of said head and the adjacent row of said cluster of bristles, all of said rows being positioned such that lower, free ends of said bristles all point inwardly toward each other; said head is able to accept a flow of water and allowing said flow into and through all of said gaps, continuing down, into and over, the full length of said bristles; there being a hollow receptacle open at both ends and being removably joined to the other end of said handle; said receptacle's other end including a multi-sized threaded mouthpiece which is able to be engaged to a threaded water faucet or garden hose; said receptacle, also being able to be attached directly to said head when said handle is detached completely from both said head and said receptacle; said receptacle is able to accept a flow of water from said faucet or hose thus allowing said flow to pass into said head directly from said receptacle if attached thereto, or into said handle from said receptacle if attached thereto for cleaning paint clinging to the bristles.

2. A brush in accordance with claim 1, wherein when said brush is in use for a painting operation, said gaps are sufficient to prevent the flow of paint from said bristles onto said outer walls of said brush head.

3. A brush comprising a hollow handle open at both ends, a brush head having inside walls removably attached to one end of said handle, and a hollow receptacle removably attached to the other end of said handle; brush fibres extending out from one end of said head, said fibres arranged horizontally in rows, side by side, said rows being secured to the inside walls of said head, with gaps between all of said rows and gaps between each inside wall of said head and adjacent rows of fibres; said head is able to accept a flow of water passing through said receptacle and handle to pass then into said gaps, down the full length of all said fibres, as well as between them; said rows of fibres are so positioned to have their lower free ends, converge inwardly toward each other; said receptacle's other end is able to be attached to different sizes of water faucets or garden hoses; said receptacle also being able to be directly attached to the separated head to allow passage of said flow into said head for cleaning paint clinging to the bristles.

* * * * *